United States Patent [19]

Rothman

[11] 4,218,875

[45] Aug. 26, 1980

[54] ALARM

[76] Inventor: Michael L. Rothman, 21 Commonwealth Rd., Watertown, Mass. 02172

[21] Appl. No.: 828,047

[22] Filed: Aug. 26, 1977

[51] Int. Cl.[2] ..... G04B 37/12

[52] U.S. Cl. ..... 368/73; 58/16 R; 340/384 E; 368/12; 368/72; 368/262

[58] Field of Search ..... 58/16 R, 16 D, 57.5, 58/21.15, 19 R–19 C, 38 R, 38 A, 152 B; 340/384 E, 392; 325/396

[56] References Cited

U.S. PATENT DOCUMENTS

| | | | |
|---|---|---|---|
| 327,919 | 10/1885 | Burmann | 58/57.5 |
| 1,361,413 | 12/1920 | Stenberg | 58/16 |
| 1,529,852 | 3/1925 | Tanglin | 58/57.5 |
| 2,771,559 | 11/1956 | Montmeat | 58/19 R X |
| 3,192,699 | 7/1965 | Stout | 58/21.15 X |
| 3,361,974 | 1/1968 | Wysong | 325/396 |
| 3,638,418 | 2/1972 | Spadini | 58/57.5 |
| 3,788,059 | 1/1974 | Spadini | 58/57.5 X |
| 3,798,889 | 3/1974 | Chadwick | 58/38 X |
| 3,971,207 | 7/1976 | Murakami et al. | 58/152 B |
| 4,028,882 | 6/1977 | Muncheryan | 58/152 B |
| 4,144,706 | 3/1979 | Willis | 58/57.5 |

*Primary Examiner*—Ulysses Weldon

[57] ABSTRACT

An alarm clock having a removable throwable alarm.

6 Claims, 4 Drawing Figures

ALARM

FIELD OF THE INVENTION

This invention relates to audible signal devices and more particularly to alarms for clocks and like instrumentalities that activate the alarm at a selected time.

BACKGROUND OF THE INVENTION

Alarm clocks and like devices provided with integral audible signals and apparatus for actuating the signal at a selected time and until the signal is manually arrested by means of a switch are well known.

Such alarms usually arouse the slumbering person in an annoying manner.

SUMMARY OF THE INVENTION

I have invented an alarm which is demountably attached to a clock and is adapted to be removed from the clock when activated and to be thrown against a surface to arrest its audible signal. In addition to arousing the user, my throwable alarm provides a cathartic effect which assuages the annoyance of the user at being awakened by creating in the user a sensation of having destroyed the object which has disturbed him.

In preferred embodiments, my alarm emits a first sound when energized and a second sound when deactivated to create the impression that the alarm has been destroyed; the first sound is a pulsating tone, the magnitude of the pulses being substantially constant, and the second sound is a continuous tone decaying in magnitude.

My alarm is inexpensive, safe, reliably effective and reusable.

PREFERRED EMBODIMENT

I turn now to drawings and description of a preferred embodiment of the invention.

Drawings

DESCRIPTION

Figure 1:
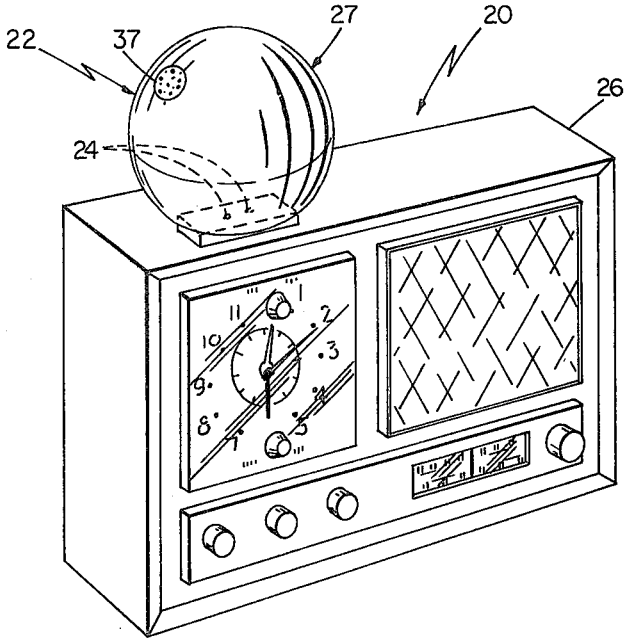
FIG. 1 is a perspective view of a clock radio having an alarm according to the invention.

The embodiment shown in the drawings and its operation are now described.

1. EMBODIMENT

There is shown in FIG. 1 an electric clock radio 20 having an alarm 22 removably mounted to terminals 24 on chassis 26.

Figure 2:
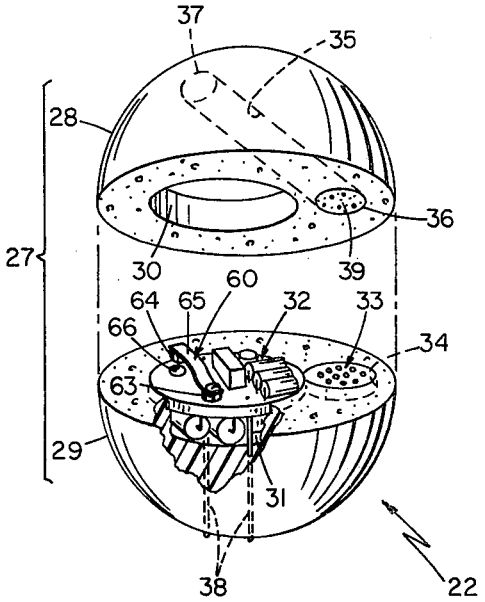
FIG. 2 is a somewhat schematic, partially exploded and broken away view of the alarm.

As shown in FIG. 2, alarm 22 has a spherical casing 27 formed by upper and lower hemispherical portions 28 and 29 which are fabricated from foam rubber. The diameter of spherical casing 27 is sized to permit the user to grip the casing in one hand.

Upper and lower hemispheres 28 and 29 have opposed cavities 30 and 31 positioned near their centers to house alarm circuitry 32, which is connected to signal 33, itself housed in cavity 34 adjacent cavity 31 in lower hemisphere 29. Upper hemisphere 28 has a passage 35 extending therethrough having an interior end 36, opposite signal 33 and an exterior end 37 on the outer surface of upper hemisphere 28.

Electrical leads 38 extend through lower hemisphere 29 and slightly outwardly from the exterior surface thereof to provide connections for mounting alarm 22 to terminals 24 on chassis 26.

After the alarm circuitry 32 and signal 33 are secured within lower hemisphere 29, upper hemisphere 28 is fastened to lower hemisphere 29 by glue. Then passage 35 is filled with acoustically transmissive forty-pore per cubic inch foam rubber 39.

Figure 3:
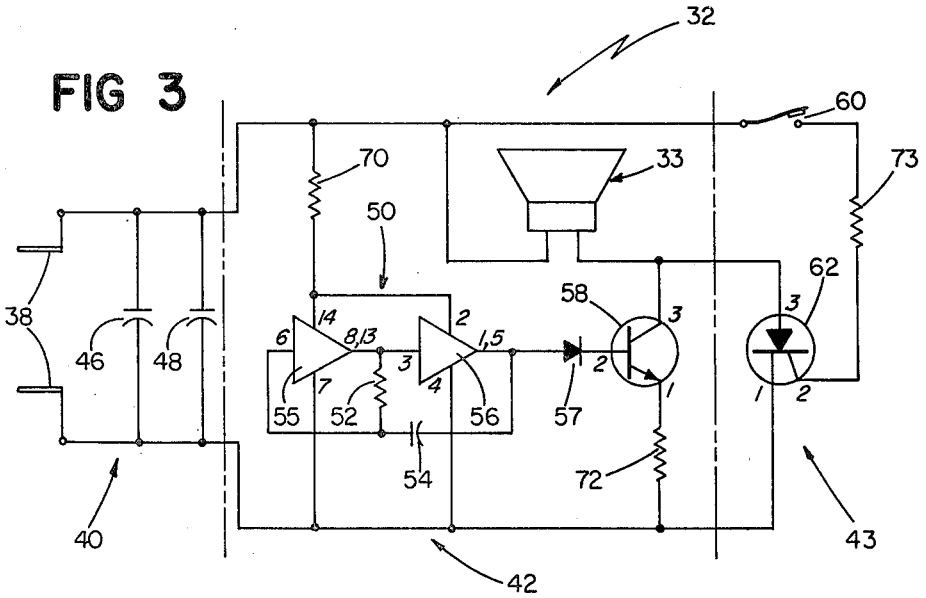
FIG. 3 is a circuit diagram of the alarm circuitry.

Alarm circuitry 32 shown in FIG. 3 comprises an energy source 40 and two switching circuits 42 and 43 which control the flow of current to audible signal 33.

Energy source 40 includes leads 38 and capacitors 46 and 48. Leads 38 are adapted to provide a connection to clock circuitry 80 (FIG. 4) in clock 20 when alarm 22 is mounted to terminals 24 on chassis 26.

Switching circuit 42 includes a multivibrator 50, comprising a resistor 52 and a capacitor 54 connected to integrated circuits 55 and 56, coupled through a diode 57 to the base of a transistor 58. The reference numerals of the integrated circuits are provided to indicate how resistor 52 and capacitor 54 are connected thereto.

Switching circuit 43 consists of an impact sensitive switch 60 connected to a thyristor 62. Impact sensitive switch 60 is composed of two 6–32 brass nuts 63 and 64 soldered to a one inch phosphor-bronze flat spring 65. Electrical contact is made through brass screw 66.

The alarm circuit elements, including resistors 70, 72, and 73 are described in more detail in Table A.

Table A

| Element | Description |
|---|---|
| Audible Signal 33 | "Sonalert": Mallory #5C628 solid state warning device |
| Capacitors 46, 48 | 200 μf, 16 volt electrolytic capacitor |
| Resistor 52 | 1.3 MΩ, ¼ watt |
| Capacitor 54 | 0.27 μf, 50 volt aluminized mylar capacitor |
| Integrated circuits 55, 56 | RCA CD 4007A integrated circuit |
| Diode 57 | IN914 silicon diode |
| Transistor 58 | 2N2270 transistor |
| Thyristor 62 | 2N2322A thyristor |
| Resistor 70 | 470 KΩ, ¼ watt |
| Resistor 72 | 15Ω, ¼ watt |
| Resistor 73 | 200 KΩ, ¼ watt |

Figure 4:
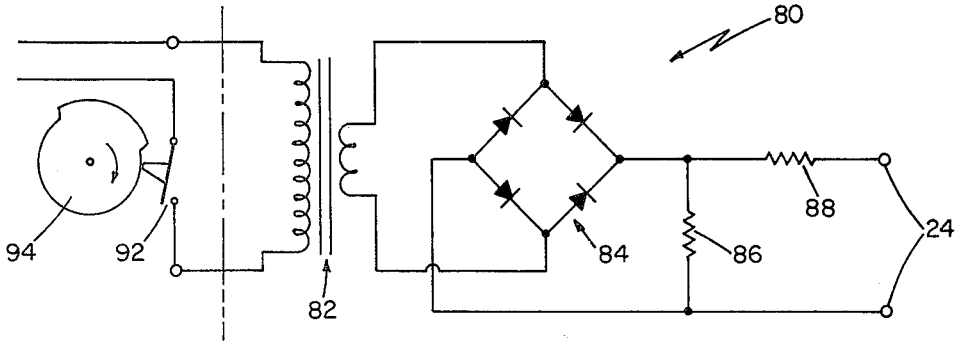
FIG. 4 is a circuit diagram showing modification of conventional clock radio circuitry for use in the invention.

Clock circuitry 80 is shown in FIG. 4. Clock circuitry 80 modifies the conventional circuitry 90 in clock radio 20 which includes a switch 92 which is closed by a cam 94 at a preselected awakening time set by the user. The clock circuitry modifies the conventional house current supplied to radio 20 to provide a difference in potential of approximately 12 volts D.C. to terminals 24 when switch 92 is closed.

The clock circuitry includes a transformer 82, a solid state bridge rectifier 84, and resistors 86 and 88 more fully described in Table B.

Table B

| Element | Description |
|---|---|
| Transformer 82 | Stancor P8384, 12 volts at 1 amp. |
| Rectifier 84 | International rectifier #18DB6A |
| Resistor 86 | 1 KΩ, 1 watt |
| Resistor 88 | 100 Ω, 2 watt |

2. OPERATION

In the usual way, the user sets clock radio 20 to have alarm 22 sound at a selected time. At the preselected time, cam 94 closes switch 92, supplying current to clock circuitry 80. Circuitry 80 modifies the A.C. current to provide a 12 volt D.C. difference in potential at terminals 24—thereby providing current to alarm circuitry 32 through leads 38 which are connected to terminals 24.

The current provided to alarm circuitry 32 from clock circuitry 80 charges capacitors 46 and 48 and activates audible signal 33 through switching circuit 42.

Switching circuit 42 operates as follows: multivibrator 50 sends a pulsating signal to transistor 58, which transistor switches on and off causing transmission of pulses of current through to audible signal 33, causing it to emit a pulsating tone; the resistor 52 and capacitor 54 control the current signals, and for the sizes given in Table A will produce a tone which pulsates about once every second.

The pulsating tone emitted by audible signal 33 awakens the user, who then grips casing 27 and removes alarm 22 from chassis 26 disconnecting leads 38 from terminals 24. Capacitors 46 and 48, which have been charged, continue to energize audible signal 33, which continues to emit a pulsating tone.

The user then throws alarm 22 against a surface causing impact sensitive switch 60 to close momentarily, thereby activating thyristor 62 to send audible signal 33 a continuous current signal which decays in magnitude as capacitors 46 and 48 are quickly discharged. This causes audible signal 33 to emit a corresponding continuous and quickly decaying tone deactivating the signal.

The user then resets radio 20 and remounts alarm 22 on chassis 26 for the next use.

If, after alarm 22 is activated, the user desires to reset radio 20 without detaching and throwing the alarm, resistor 86 will discharge capacitors 46 and 48 to arrest audible signal 33.

Resistor 88 is provided to protect rectifier 84 should there be an accidental short circuiting of terminals 24.

What is claimed is:

1. In an improved alarm clock having an electric clock portion and a removable electric alarm portion, wherein said alarm portion has a signal which emits an audible sound when activated by said clock portion at a preselected time, the improvement comprising, said alarm portion having an energy storage means for enabling said signal to continue to emit the audible sound after said alarm portion is removed from said clock portion, said alarm portion being throwable and having an impact switch means adapted to deenergize said storage means upon impact of said thrown alarm portion against an object thereby temporarily closing said switch for deactivating said signal, and said alarm portion having an impact-absorbing casing to protectively house said signal upon impact, whereby said alarm portion is reusable after impact.

2. The alarm clock of claim 1 wherein said energy storage means comprises an electrical energy storage device, said energy storage device energizing said alarm portion after said alarm portion has been removed from said clock portion.

3. The alarm clock of claim 1 wherein said clock portion energizes said alarm portion until said alarm portion is removed from said clock.

4. The alarm clock of claim 1 wherein said alarm portion further comprises a multivibrator circuit, said circuit causing a transistor to become alternatingly conductive, said transistor, when conductive, completing a current path through said signal.

5. The alarm clock of claim 4 wherein said signal emits a pulsating tone when said transistor is alternatingly conductive.

6. The alarm clock of claim 5 wherein an alternate current path is completed and maintained through said signal after said impact switch means has been temporarily closed, said signal emitting a decaying, continuous tone while current flows through the alternate current path.

* * * * *